US012578104B2

(12) United States Patent
Kanematsu et al.

(10) Patent No.: US 12,578,104 B2
(45) Date of Patent: Mar. 17, 2026

(54) VENTILATION DEVICE

(71) Applicant: Panasonic Intellectual Property Management Co., Ltd., Osaka (JP)

(72) Inventors: Daisuke Kanematsu, Aichi (JP); Masafumi Tsubouchi, Aichi (JP); Koki Ando, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 476 days.

(21) Appl. No.: 18/034,723

(22) PCT Filed: Nov. 19, 2021

(86) PCT No.: PCT/JP2021/042682
§ 371 (c)(1),
(2) Date: May 1, 2023

(87) PCT Pub. No.: WO2022/118688
PCT Pub. Date: Jun. 9, 2022

(65) Prior Publication Data

US 2023/0400200 A1 Dec. 14, 2023

(30) Foreign Application Priority Data

Dec. 4, 2020 (JP) ..... 2020-201421

(51) Int. Cl.
*F24F 7/007* (2006.01)
*F24F 13/20* (2006.01)

(52) U.S. Cl.
CPC ..... *F24F 7/007* (2013.01); *F24F 13/20* (2013.01)

(58) Field of Classification Search
CPC ..... F24F 7/007; F24F 13/20; F04D 25/12
See application file for complete search history.

(56) References Cited

FOREIGN PATENT DOCUMENTS

| | | | |
|---|---|---|---|
| JP | H06-207733 A | | 7/1994 |
| JP | 2009186060 A | * | 8/2009 |
| JP | 2018-021739 A | | 2/2018 |
| JP | 2019-158325 A | | 9/2019 |
| JP | 2020-046150 A | | 3/2020 |

OTHER PUBLICATIONS

International Search Report for corresponding Application No. PCT/JP2021/042682, mailed Feb. 1, 2022.

* cited by examiner

*Primary Examiner* — Allen R. B. Schult
(74) *Attorney, Agent, or Firm* — Renner, Otto, Boisselle & Sklar, LLP

(57) ABSTRACT

A ventilator includes a box having an air inlet on a bottom surface of the box and an air outlet on a side surface different from the bottom surface of the box, a fan case for storing a fan and sending air from the air inlet to the air outlet, and an adapter fixed to the side surface of the box where the air outlet is disposed as a component independent of the box. The fan case includes a temporary fixation for temporarily fixing the adapter to the box.

6 Claims, 15 Drawing Sheets

VENTILATION DEVICE

TECHNICAL FIELD

The present disclosure relates to a ventilator to be installed in a ceiling and any other location of a building.

BACKGROUND ART

PTL 1 discloses a conventional ventilator including a box and an adapter as independent components for easy installation in a ceiling.

The conventional ventilator is explained with reference to FIG. 14 and FIG. 15. FIG. 14 is a detailed structural drawing of the conventional ventilator. FIG. 15 is a detailed structural drawing of another conventional ventilator.

The conventional ventilator in FIG. 4, which is installed in the ceiling and any other location of a building, includes box 101 having an air inlet on the bottom surface and an air outlet on the side surface. Box 1 includes blower 102 for sending air from the air inlet to the air outlet.

A ventilator is generally installed mainly in two ways. The first way is to install the ventilator in an attic before hanging the ceiling. The second way is to install the ventilator on an existing ceiling, this is so-called "RETROFIT".

The second way (RETROFIT) is to fix adapter 103 to the ceiling and then fix box 101 to adapter 103. This allows the ventilator to be installed in a small opening provided on the ceiling. As such, "RETROFIT" is available for various situations because the ventilator can be additionally installed in existing environment.

In addition, PTL 2 discloses another conventional ventilator structured to include guides attached on side surfaces of a box as the third way. The guides allow the box to properly engage with a sloped adapter, leading to maintaining air tightness. As shown in FIG. 15, guide 202 is attached on at least one side surface of box 201 and allows box 201 to properly engage with adapter 203. This intends to install the ventilator easily and regularly in a desired position.

CITATION LISTS

Patent Literatures

PTL1: Japanese Unexamined Patent Application Publication No. 2018-21739

PTL2: Japanese Unexamined Patent Application Publication No. 2019-158325

SUMMARY OF THE INVENTION

Unfortunately, installing the ventilator on a thin and weak ceiling is difficult for RETROFIT. Adapter 103, previously fixed to the ceiling, is ducted to pass air through, resulting in some load applied on adapter 103. Then adapter 103 is sloped toward the duct on the thin and weak ceiling. This causes difficulty in inserting box 101 into the small opening provided on the ceiling and properly engaging box 101 with adapter 103 sloped toward the duct.

For RETROFIT, adapter 103 and box 101 are independent components as mentioned above. This structure causes adapter 103 to be loaded by the duct and a gap between adapter 103 and box 101, resulting in reduction in airtightness of the ventilator.

As such, the third way mentioned above, where the guides are provided on the side surfaces of the box, is applicable to maintain airtightness in addition to properly engaging the box with the sloped adapter.

Unfortunately, the third way remains inconvenient because just inserting box 201 into the ceiling leaves it still unfixed, then box 201 needs to be fixed to the ceiling by screws and/or any other fixing means. Specifically, an installer needs to support unfixed box 201 by one hand while holding a tool and screws by the other hand. Or workability for the installer needs to be further improved.

Thus, the disclosure intends to provide yet another ventilator, where an adapter and a box are independent components, to improve airtightness and workability.

The ventilator according to an embodiment of the disclosure includes the box, where an air inlet is disposed on the bottom surface and an air outlet is disposed on a side surface different from the bottom surface, a fan case for storing a fan, which sends air from the air inlet to the air outlet, and the adapter to be fixed to the side surface of the box as a component independent of the box. The fan case includes a temporary fixation to temporarily fix the box to the adapter.

The present disclosure allows the ventilator, where the adapter and the box are the independent components, to improve airtightness and workability.

DESCRIPTION OF THE EMBODIMENTS

Hereinafter, embodiments of the present disclosure will be explained with reference to the accompanying drawings. Note that each of the embodiments explained hereinafter shows a specific example of the present disclosure and should not be construed to limit the technical scope of the present disclosure. The same symbols are used for the components that are substantially the same each other and the repetitive explanation thereof may be omitted or simplified throughout the drawings.

First Embodiment

Figure 1:
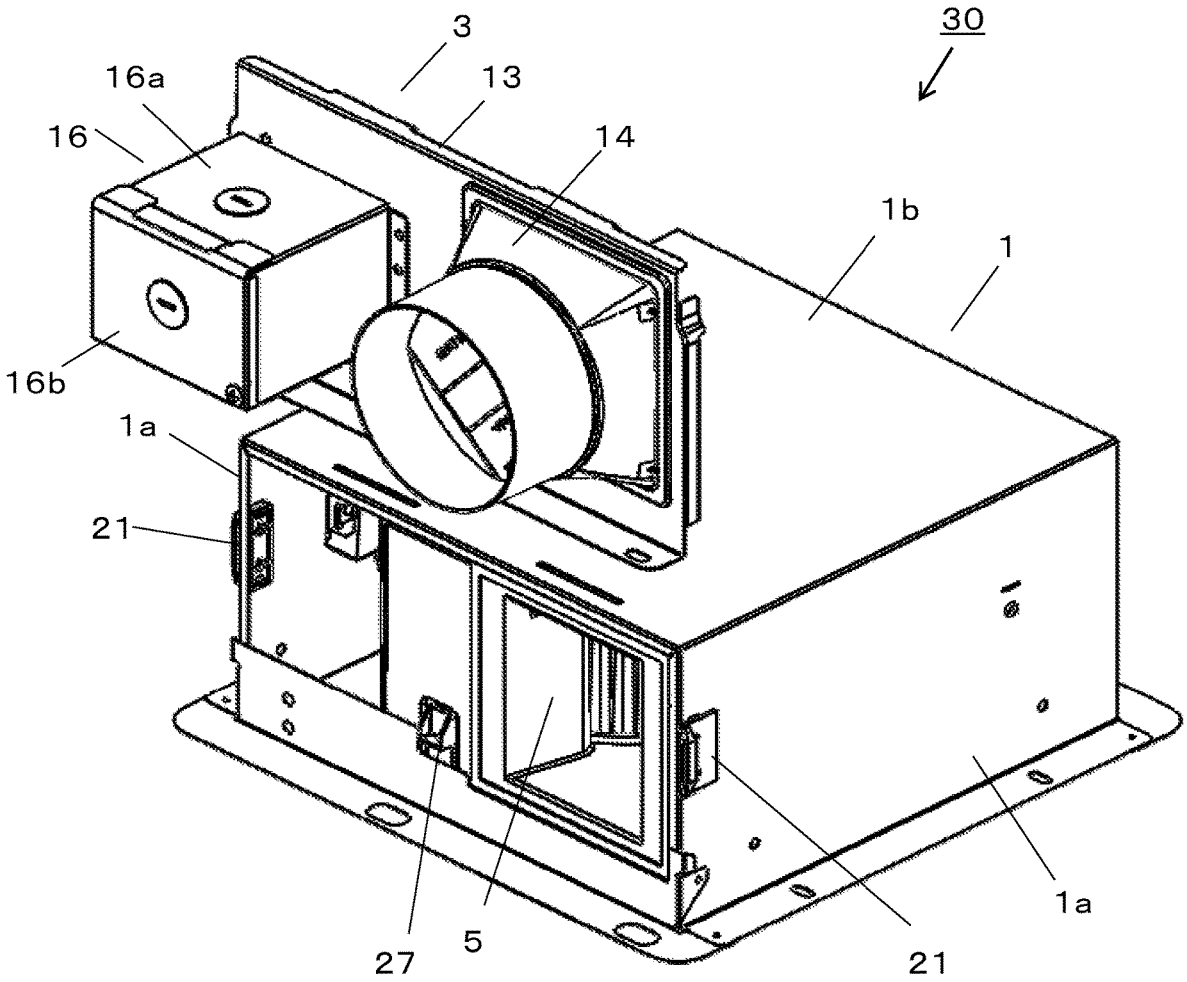
FIG. 1 is an exploded perspective view of a ventilator according to the present disclosure.
Figure 2:
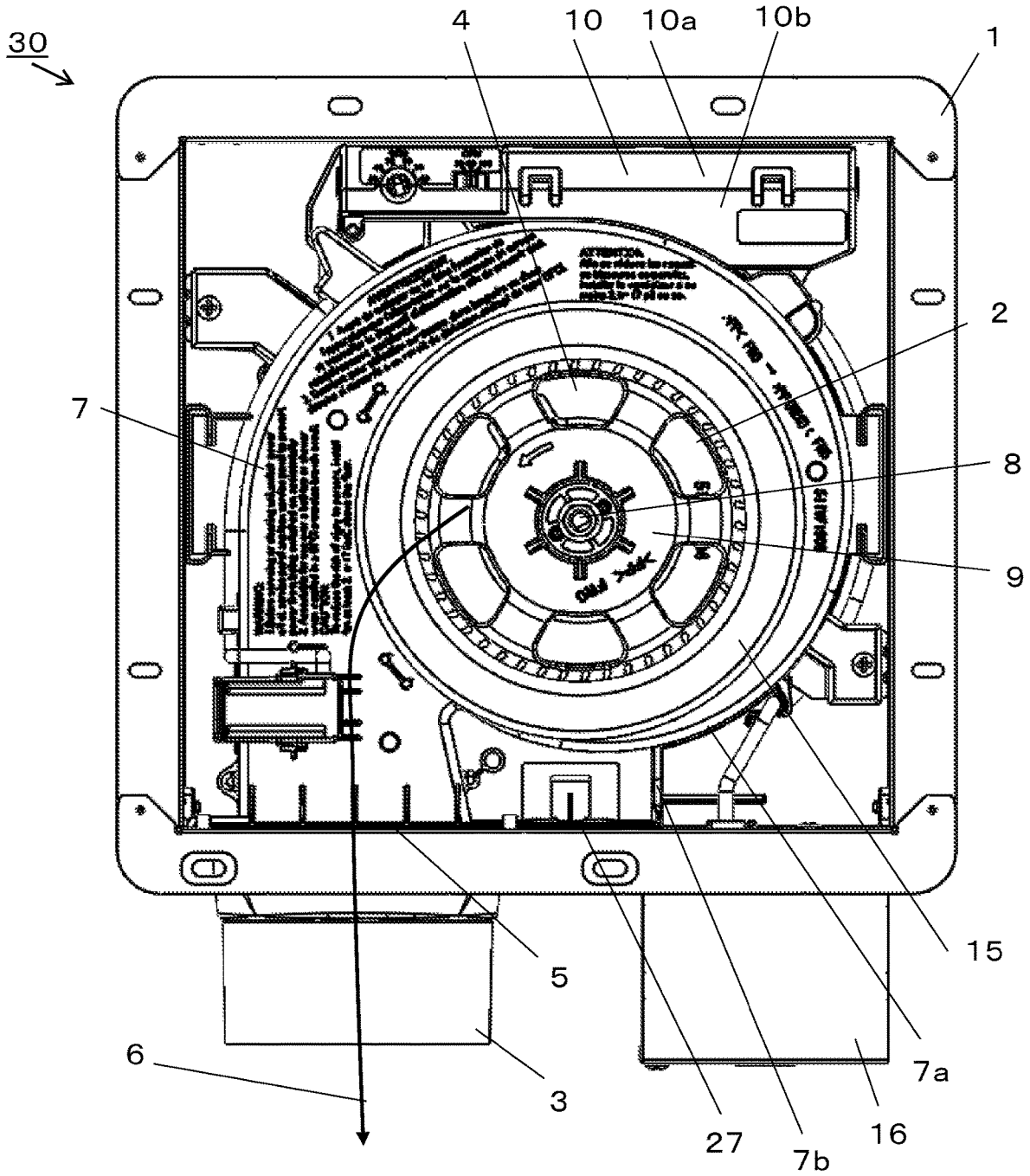
FIG. 2 is a bottom view of the ventilator.
Figure 3:
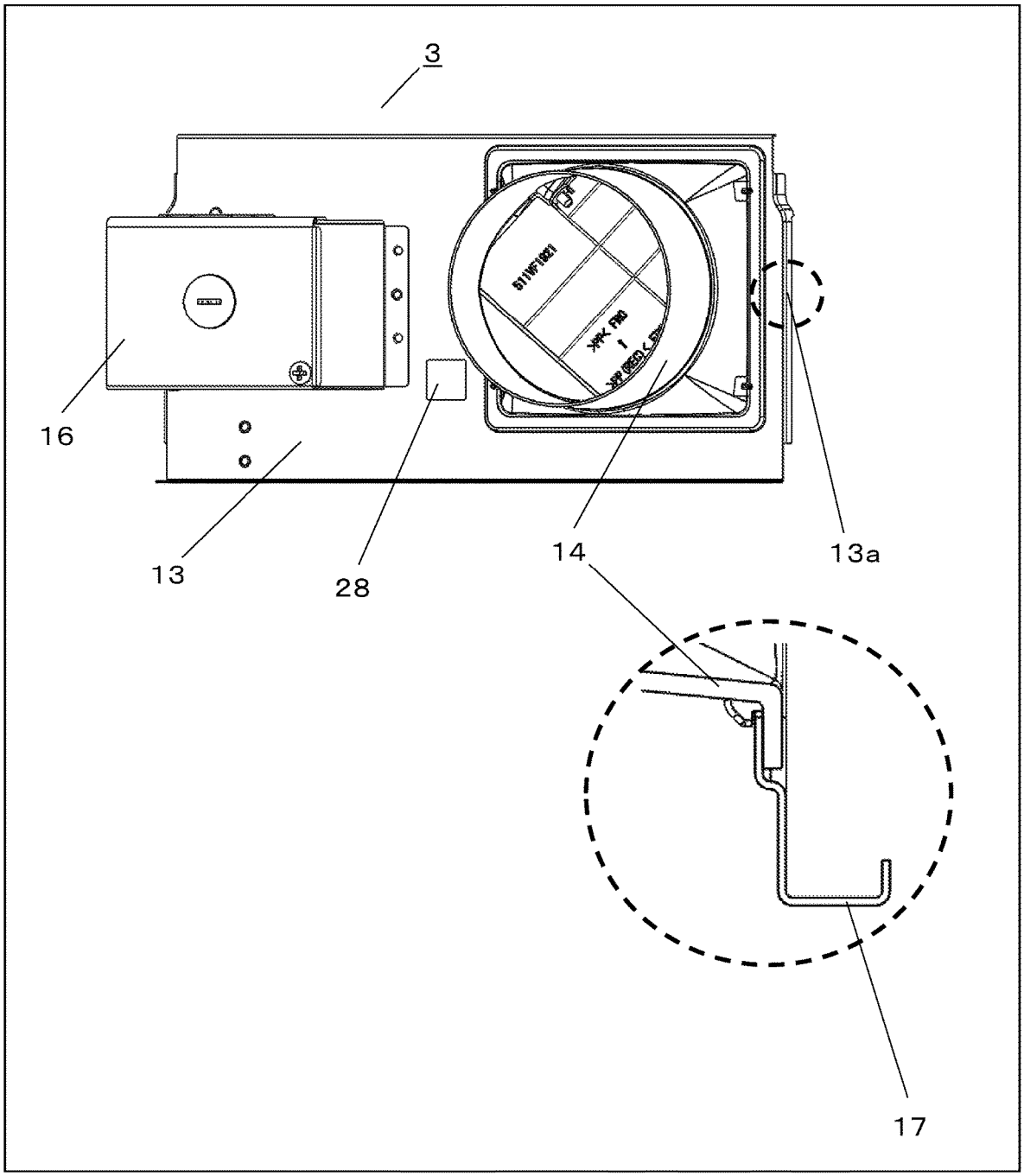
FIG. 3 is a side perspective view of an adapter.
Figure 4:
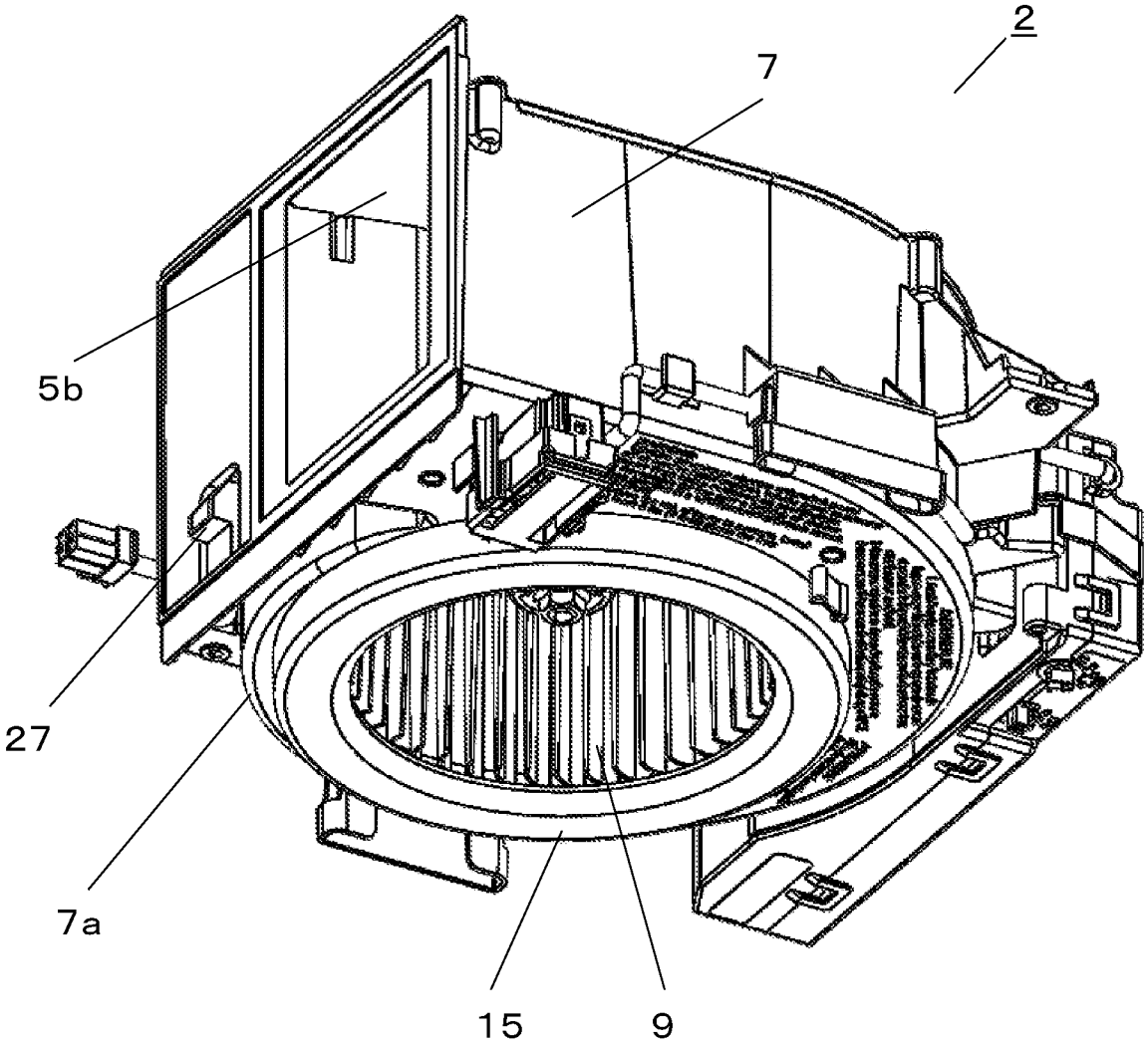
FIG. 4 is a perspective view of a blower.
Figure 5:
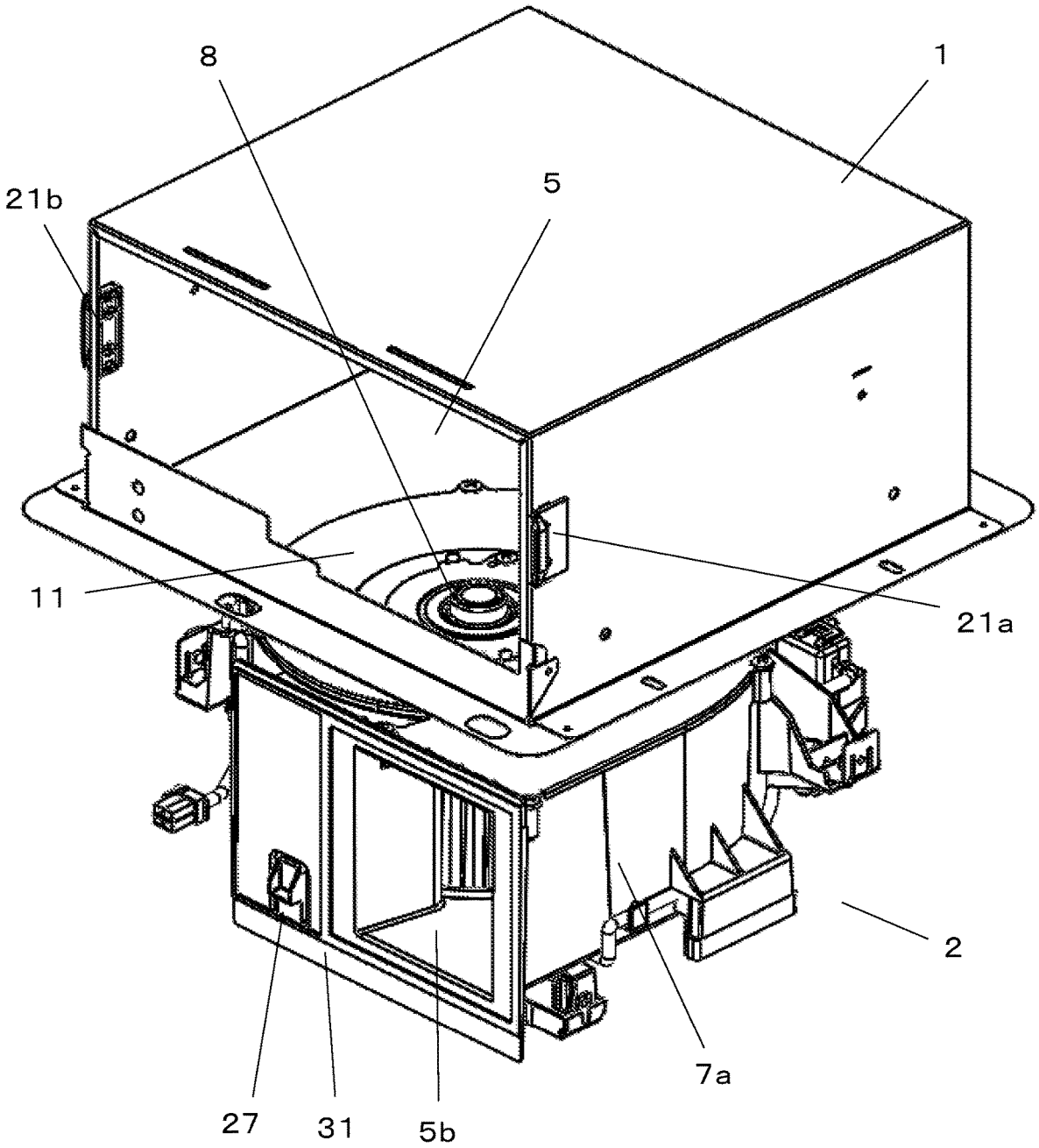
FIG. 5 is an exploded perspective view of a box and the blower.
Figure 6:
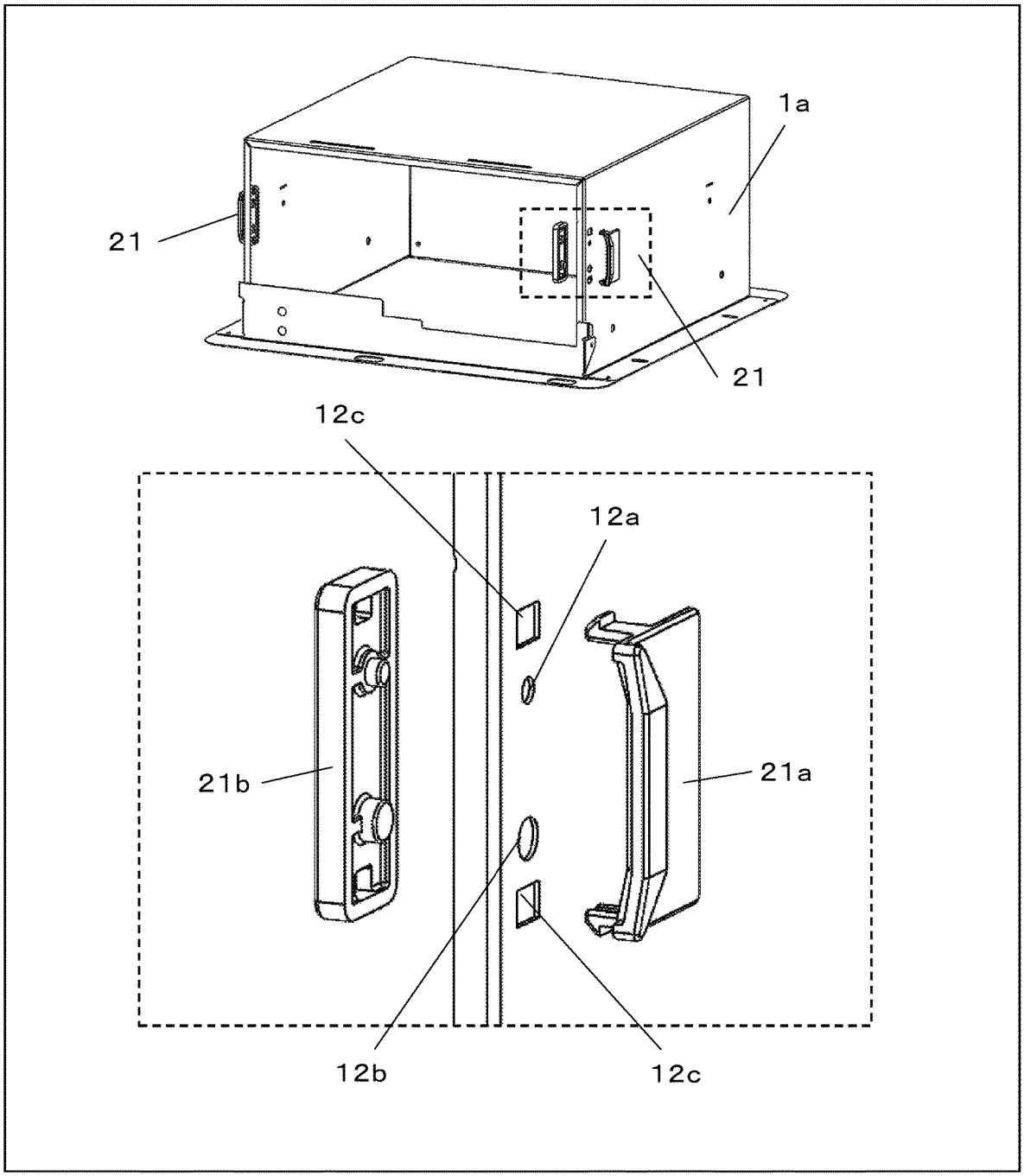
FIG. 6 is a detailed structural view of connection between through holes on a side surface of the box and guide members.

A structure of ventilator 30 according to the first embodiment of the present disclosure is explained with reference to FIG. 1 through FIG. 6. FIG. 1 is an exploded perspective view of ventilator 30 according to the first embodiment. FIG. 2 is a bottom view of ventilator 30. FIG. 3 is a side perspective view of adapter 3. FIG. 4 is a perspective view of blower 2. FIG. 5 is an exploded perspective view of box 1 and blower 2. FIG. 6 is a detailed structural view of connection between through holes on a side surface of the box and guide members.

Ventilator 30 according to the present disclosure includes box 1, blower 2 and adapter 3.

Box 1 is made of metal or resin and includes at least an open side surface. Box 1 includes air inlet 4 and air outlet 5. Box 1 further includes through hole 12*a*, through hole 12*b* and square through holes 12*c* on another side surface.

Air inlet 4 corresponds to a bottom surface of box 1 and is disposed to be vertically directed to a ground surface where the bottom surface of ventilator 30 and the ceiling are on the same plane surface. Air passes through an unillustrated design panel and is sent to box 1.

Air outlet 5 is an opening disposed on a side surface adjacent to the bottom surface of box 1. Air outlet 5 is disposed to fully open the side surface of box 1, however, air practically passes through only air outlet 5*b*, which is an opening disposed on blower 2.

Air inlet 4 and air outlet 5 communicate with each other inside box 1 and an air path between them partially serves as exhaust air path 6.

Blower 2 is disposed in exhaust air path 6 to send air from air inlet 4 to air outlet 5. Blower 2 includes fan case 7, motor 8, fan 9 and motor support 11.

Fan case 7 is a resin cover of blower 2 and is substantially cylindrical. Fan case 7 has an air inlet opening on the bottom surface and an air outlet opening on a side surface. Fan case 7 includes scroller 7*a*, temporary fixing reinforce 7*b* and outlet aperture plate 31.

Scroller 7*a* is a part of fan case 7 and is open on the bottom close to air inlet 4. Air outlet 5*b* close to scroller 7*a* and air outlet 5 of box 1 are disposed on the same plane. The horizontal cross-sectional surface of scroller 7*a* is round scroll shape. Scroller 7*a* includes fan 9 and has orifice 15 on the bottom. Outlet aperture plate 31 close to scroller 7*a* includes air outlet 5*b*.

Temporary fixing reinforce 7*b* is a part of fan case 7 and is integrally formed with outlet aperture plate 31 close to scroller 7*a*.

Outlet aperture plate 31 is rectangular and includes air outlet 5*b*. Outlet aperture plate 31 is disposed to partially block air outlet 5 of box 1. Temporary fixation 27 is disposed close to air outlet 5*b* on outlet aperture plate 31.

Figure 9:
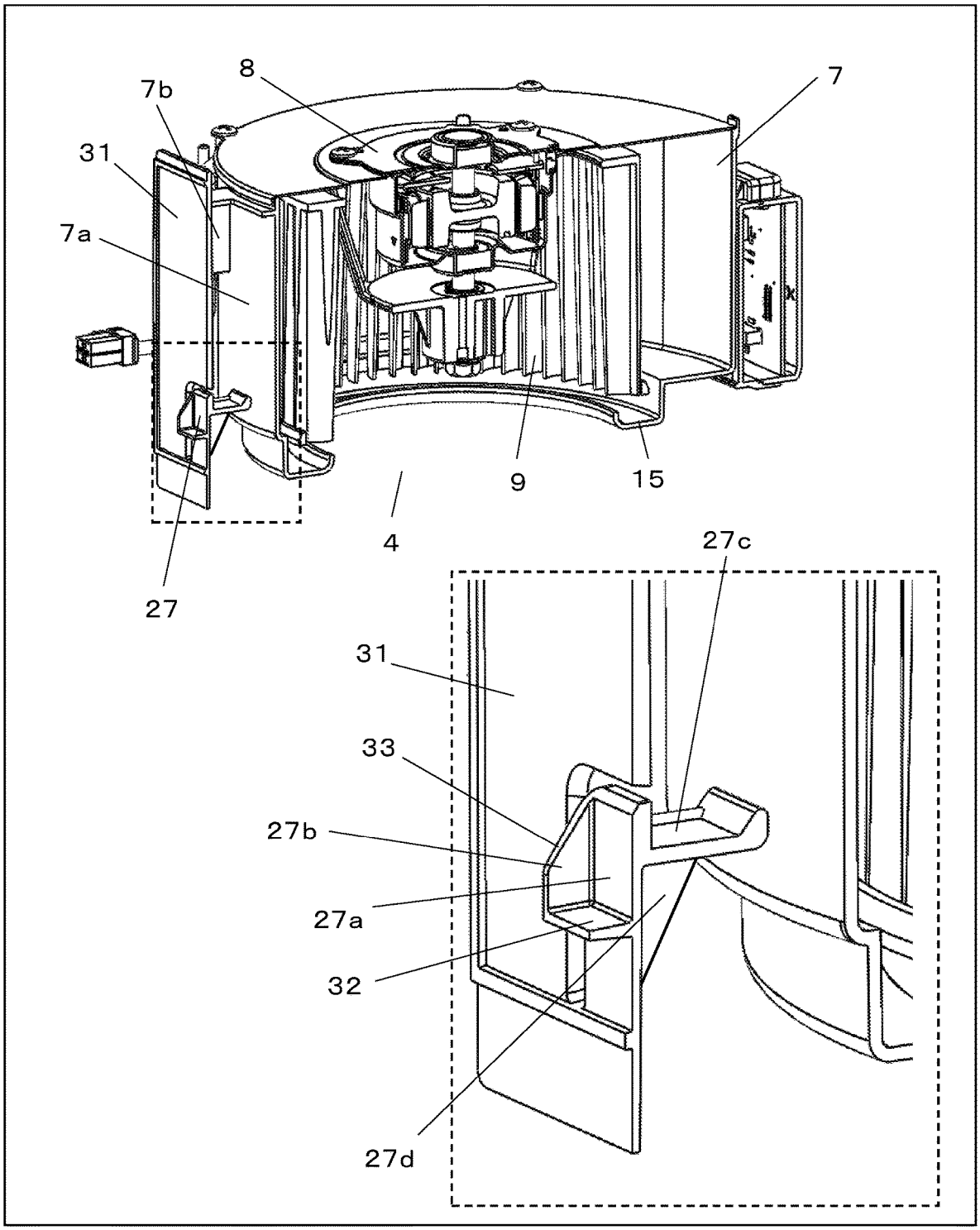
FIG. 9 is a structural cross-sectional view of a temporary fixation.

As indicated in FIG. 9, temporary fixation 27 is configured to include base 27*a*, stopper 27*b*, engagement release 27*c* and reinforce 27*d*. Temporary fixation 27 is detailed later.

Scroller 7*a* and temporary fixation 27 are integrally formed with fan case 7, however, they may be independent components. In that case, temporary fixation 27 is attached to fan case 7 with screws and/or any other fixing means.

An example of motor 8 is a DC motor having a rotational shaft protruding toward air inlet 4. Motor 8 is disposed inside fan case 7 close to top plate 1*b* and attached around the center of motor support 11 with screws and/or any other fixing means. Motor 8 operates the rotational shaft by power supplied via an unillustrated electrical board.

An example of fan 9 is a sirocco fan fixed to the rotational shaft. Behavior of the rotational shaft upon starting of motor 8 operates fan 9. Thus, blower 2 sends air from air inlet 4 to air outlet 5.

Electrical board case 10 includes electrical board base 10*a* and electrical board cover 10*b*. Electrical board base 10*a* and electrical board cover 10*b* are both made of incombustible resin. The electrical board is attached to electrical board base 10*a* with screws and/or any other fixing means. Electrical board cover 10*b* is attached to electrical board base 10*a* with screws and/or any other fixing means.

The electrical board is stored in electrical board case 10. Electrical board case 10 is attached close to fan case 7 with unillustrated screws and/or any other fixing means.

Motor support 11 is a part of the cover of blower 2 and is made of metal or resin. Motor support 11 is disposed on fan case 7 close to top plate 1*b* and is attached to fan case 7 with screws and/or any other fixing means.

Orifice 15 is a cylindrical component with the center open, which is made of resin. Orifice 15 is formed on fan case 7 close to air outlet 4. Specifically, orifice 15 is disposed upstream blower 2. Orifice 15 may be a component independent of fan case 7. In that case, the component is attached to the open bottom of fan case 7 with screws and/or any other fixing means.

Fan case 7 is attached to box 1 at a level lower than the center height of box 1 with screws and/or any other fixing means. In the first embodiment, fan case 7 is attached to box 1 with unillustrated connecting members. Motor support 11 may be alternatively attached to box 1 instead of fan case 7.

Adapter 3 serves as one of the side surfaces of box 1 and disposed downstream air outlet 5. Adapter 3 includes adapter plate 13, duct connection 14, power source connection 16 and engaged opening 28.

Adapter plate 13 is made of metal or resin and has substantially the same size as that of the side surface of box 1. Adapter plate 13 is disposed downstream air outlet 5 of box 1. Adapter plate 13 includes guide receiver 13*a* at least on one of short ends of adapter plate 13. In the first embodiment, guide receiver 13*a* is provided on each of the short ends.

As indicated in FIG. 3, guide receiver 13*a* is formed by folding each of the short ends of adapter plate 13 two times. Specifically, each of the short ends is first folded to be parallel to adjacent side surface 1*a*, then again folded toward adjacent side surface 1*a* to be parallel to adapter plate 13. Guide 3*a* has concavity 17 when adapter 3 is viewed from above in FIG. 1.

Guide 3*a* allows box 1 to engage with adapter 3. Specifically, guide member 21 disposed on adjacent side surface 1*a* vertically slides along the inner wall of concavity 17. In other words, box 1 vertically guides adapter 3 by a sliding structure between guide receiver 13*a* and guide member 21. This simultaneously restricts air outlet 5 to move toward and away from adapter 3.

Duct connection 14 is a hollow component erecting downstream adapter plate 13, which is rectangular upstream and cylindrical downstream. Duct connection 14 is made of metal or resin. The inside space of duct connection 14 communicates with air outlet 5 to draw air from box 1. Connecting a duct to duct connection 14 allows ventilator 30 to exhaust air. In the first embodiment, the rectangular portion of duct connection 14 engages with adapter plate 13. However, duct connection 14 may be bonded or fixed to adapter plate 13. Duct connection 14 and adapter plate 13 may be otherwise integrally molded.

Power source connection 16 is erected downstream adapter plate 13 and includes power connection base 16*a* and power connection cover 16*b*. Connecting indoor power source to ventilator 30 inside power source connection 16 allows operation of ventilator 30.

Power connection base 16*a* is a rectangular metal box with at least one side surface open.

Power connection cover 16*b* is also a rectangular metal box with at least one side surface open.

In the first embodiment, power connection base 16*a* and Power connection cover 16*b* are fixed to adapter plate 13 with unillustrated screws and/or any other fixing means.

Engaged opening 28 is a rectangular hole disposed on adapter plate 13, and includes sliding space 29 with respect to stopper 27*b* detailed later (Refer to FIG. 12).

The gravity center of ventilator 30 slopes toward adapter 3 or outlet 5 relative to the center of box 1. Or the rotational shaft of relatively heavy motor 8 slopes toward adapter 3 relative to the center of box 1. This allows stopper 27*b* to easily fall toward adapter 3.

Figure 7:
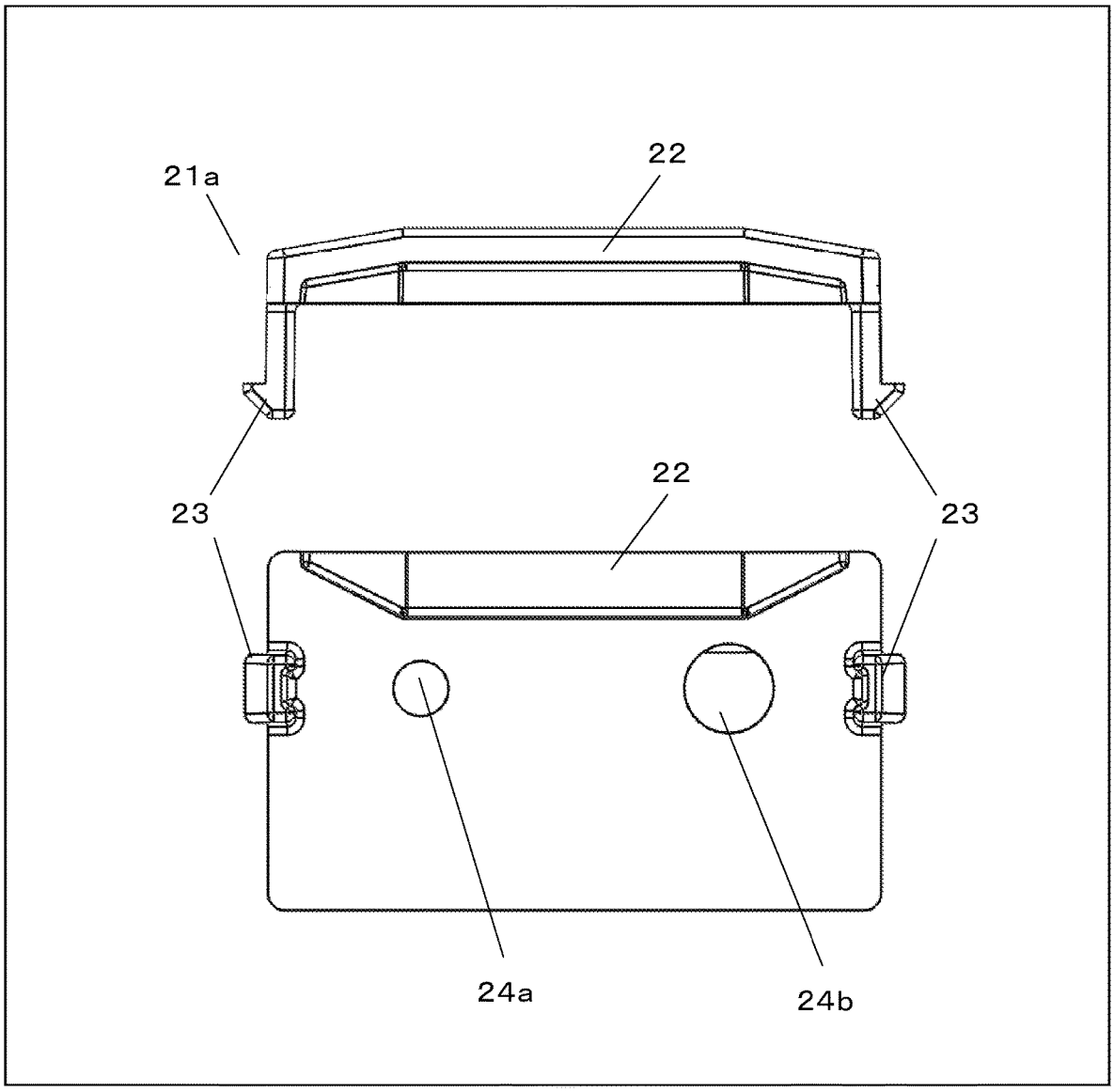
FIG. 7 is a front view and a plan view of an external guide member.
Figure 8:
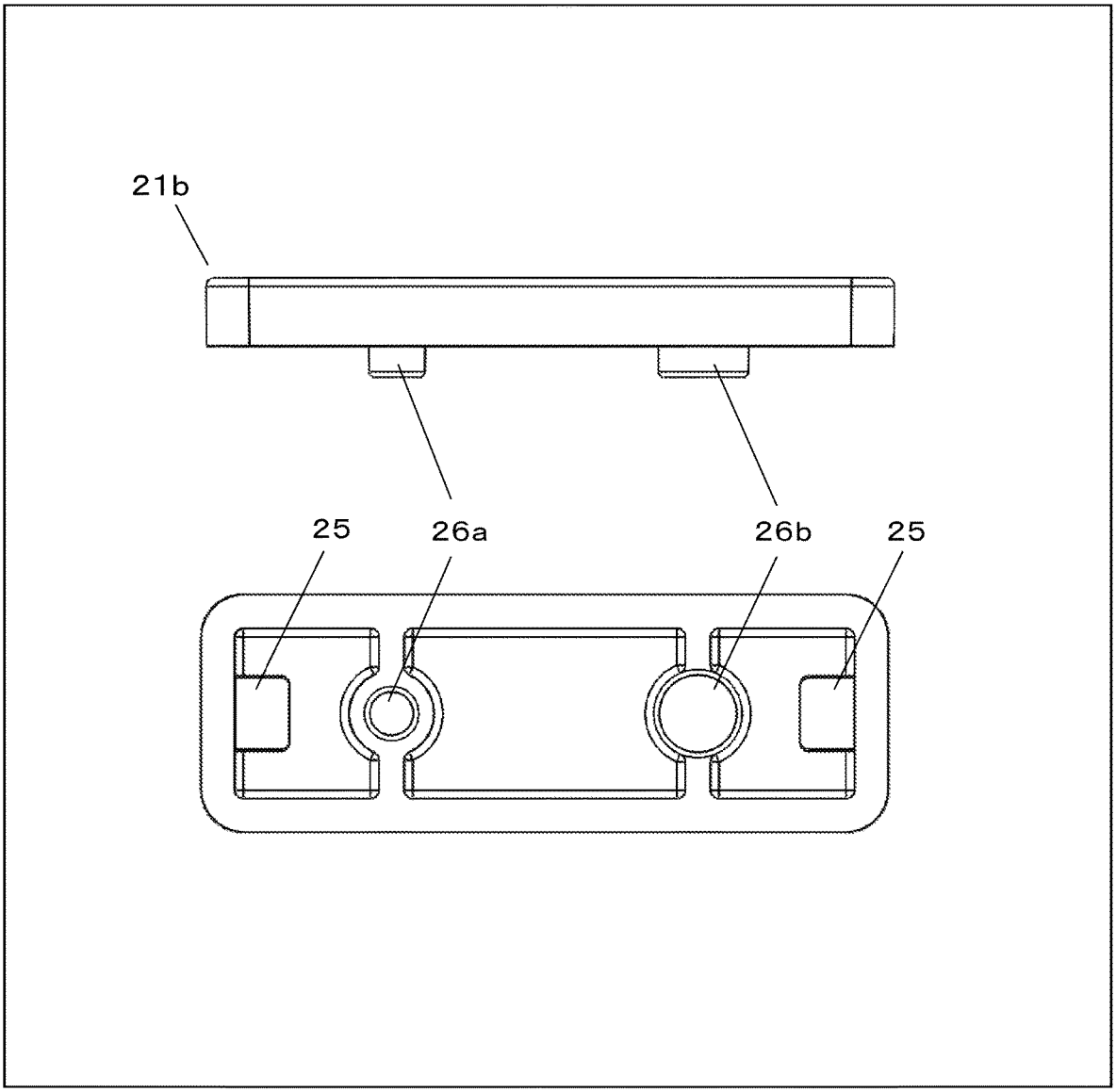
FIG. 8 is a front view and a plan view of an internal guide member.

Guide member 21 is detailed with reference to FIG. 6, FIG. 7 and FIG. 8. FIG. 6 is a detailed structural view of connection between through hole 12*a*, through hole 12*b*, square through holes 12*c* and guide members 21. FIG. 7 is a front view and a plan view of external guide member 21*a*. FIG. 8 is a front view and a plan view of internal guide member 21*b*.

Box 1 includes through hole 12*a*, through hole 12*b*, square through holes 12*c* and guide member 21 on adjacent side surface 1*a* close to air outlet 5.

Through hole 12*a* is substantially round opening disposed on adjacent side surface 1*a* close to air outlet 5 of box 1.

Through hole 12*b* is substantially round opening disposed on adjacent side surface 1*a* close to air outlet 5 of box 1.

Square through holes 12*c* are openings disposed on adjacent side surface 1*a* close to air outlet 5 of box 1.

Guide member 21 includes external guide member 21*a* and internal guide member 21*b*.

External guide member 21*a* is made of resilient resin and configured to penetrate square through holes 12*c* from the outer side of box 1. External guide member 21*a* is mostly on the outer side of box 1.

External guide member 21*a* includes bulge 22, stoppers 23, hole 24*a* and hole 24*b*.

Bulge 22 protrudes outward from adjacent side surface 1*a* and is ached on the center of the long side of external guide member 21*a*. Bulge 22 engages with concavity 17 of adapter plate 13.

Each of stoppers 23 is formed close to the long side end of bulge 22 provided on external guide member 21*a* and each protrudes inward from adjacent side surface 1*a* opposite to bulge 22. Each of stoppers 23 penetrates each of square through holes 12*c* on adjacent side surface 1*a* and engages with internal guide member 21*b*. Stoppers 23 are opposed with each other in the long direction and decentered in the short direction respectively with respect to the center line of external guide member 21*a*.

Hole 24*a* is an opening to engage with internal guide member 21*b*. The diameter of hole 24*a* is substantially the same as that of through hole 12*a*.

Hole 24*b* is an opening to engage with internal guide member 21*b*. The diameter of hole 24*b* is substantially the same as that of through hole 12*b*.

Internal guide member 21*b* is made of resilient resin and configured to penetrate through hole 12*a* and through hole 12*b* from the inner side of box 1. Internal guide member 21*b* is mostly on the inner side of box 1.

Internal guide member 21*b* includes square holes 25, protrusion 26*a* and protrusion 26*b*.

Each of square holes 25 engages with each of stoppers 23 of external guide member 21*a*.

Protrusion 26*a* engages with external guide member 21*a* via through hole 12*a* on adjacent side surface 1*a*.

Protrusion 26*b* engages with external guide members 21*a* via through hole 12*b* on adjacent side surface 1*a*.

Figure 10:
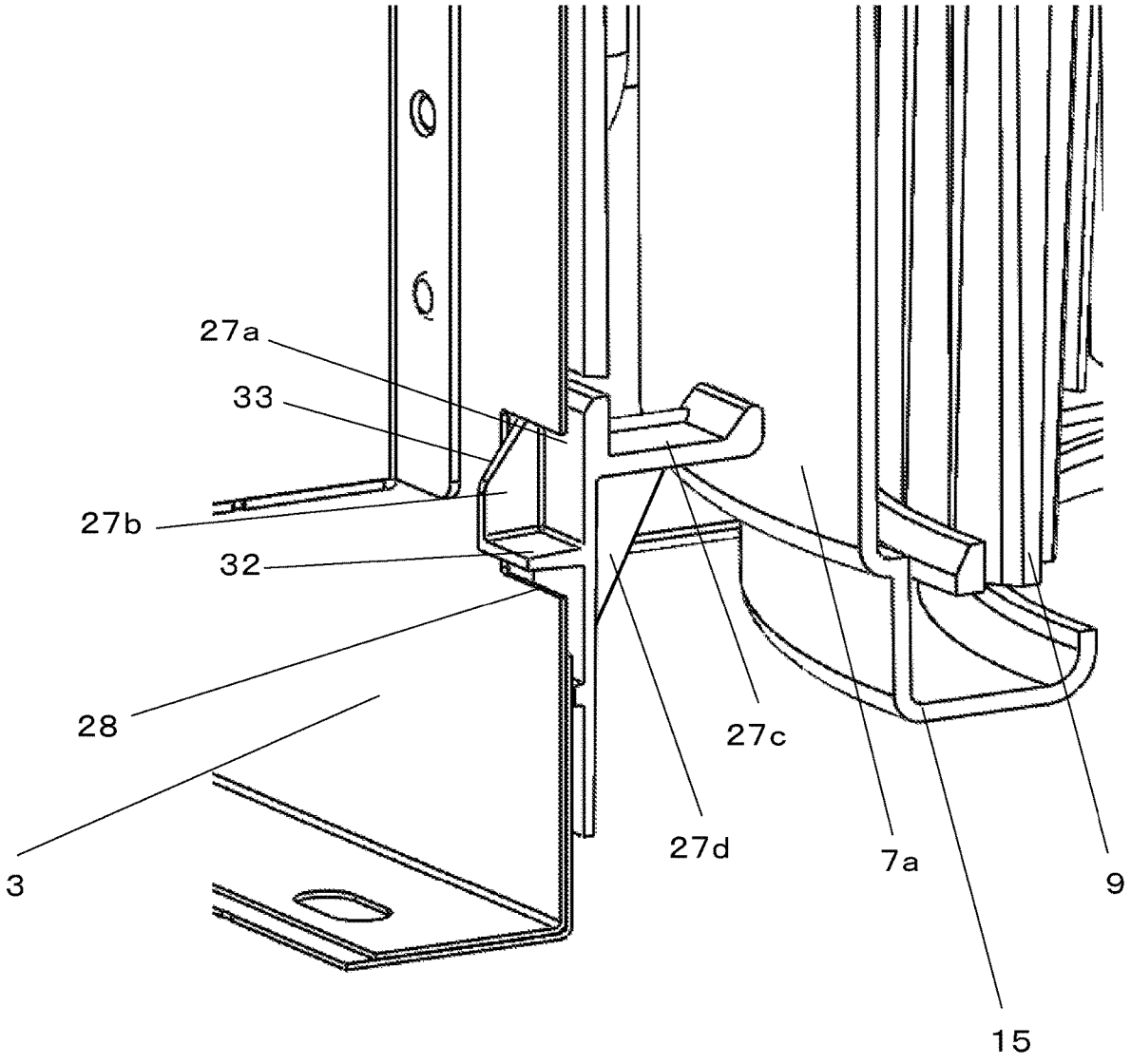
FIG. 10 is a cross-sectional perspective view of a positional relation between the temporary fixation and an engaged opening.

Temporary fixation 27 is explained with reference to FIG. 9 and FIG. 10 in detail. FIG. 9 is a structural cross-sectional view of temporary fixation 27. FIG. 10 is a cross-sectional perspective view of a positional relation between temporary fixation 27 and engaged opening 28. However, FIG. 10 omits reinforce 27*d* for explanation.

Temporary fixation 27 includes base 27*a*, stopper 27*b*, engagement release 27*c* and reinforce 27*d*.

Base 27*a* is a rectangular plate integrally molded with a temporary fixation opening disposed on outlet aperture plate 31 and is flush with outlet aperture plate 31. Thus, base 27*a* and air outlet 5 are mutually parallel. Base 27*a* is resilient to move toward and away from air outlet 5 (outlet aperture plate 31).

Stopper 27*b* is disposed close to the top of base 27*a*, specifically disposed opposite to where base 27*b* is partially joined to the temporary fixation opening. Stopper 27*b* protrudes outward air outlet 5 in the cross-sectional view. Stopper 27*b* further includes planar surface 32 and slope 33. Specifically, planar surface 32 extends from the underside of base 27*a* outward air outlet 5, and slope 33 gradually slopes toward outlet aperture plate 31.

Planar surface 32 engages with engaged opening 28 disposed on adapter plate 13 to fix box 1 storing fan case 7 to adapter 3.

Engagement release 27*c* is close to the top of base 27*a* and protrudes inward air outlet 5 in the cross-sectional view. Engagement release 27*c* protrudes opposite to stopper 27*b* across base 27*a*. Engagement release 27*c* protrudes linearly from base 27*a* toward scroller 7*a*. A clearance is provided between engagement release 27*c* and scroller 7*a* to allow a user to operate engagement release 27*c*.

Engagement release 27*c* is disposed closer to top surface 1*b* than to air inlet 4. Thus, engagement release 27*c* never blocks airflow from air inlet 4 during operation of ventilator 30, resulting in no adverse effect on ventilating performance of ventilator 30.

Reinforce 27*d* is a triangle plate close to the top of base 27*a* and joined to both base 27*a* and engagement release 27*c*. Reinforce 27*d* protrudes inward air outlet 5, or toward scroller 7*a*. Thus, reinforce 27*d* never blocks airflow from air inlet 4 during operation of ventilator 30, resulting in no adverse effect on ventilating performance of ventilator 30.

Reinforce 27*d* controls operation of engagement release 27*c* or deformation and damage due to stress. This also controls unintended release between temporary fixation 27 and engaged opening 28. Engagement between temporary fixation 27 and engaged opening 28 is described later. Operating engagement release 27*c* causes outlet aperture plate 31 to bend toward scroller 7*a*, however, temporary fixing reinforce 7*d* controls access between outlet aperture plate 31 and scroller 7*a*.

Figure 11:
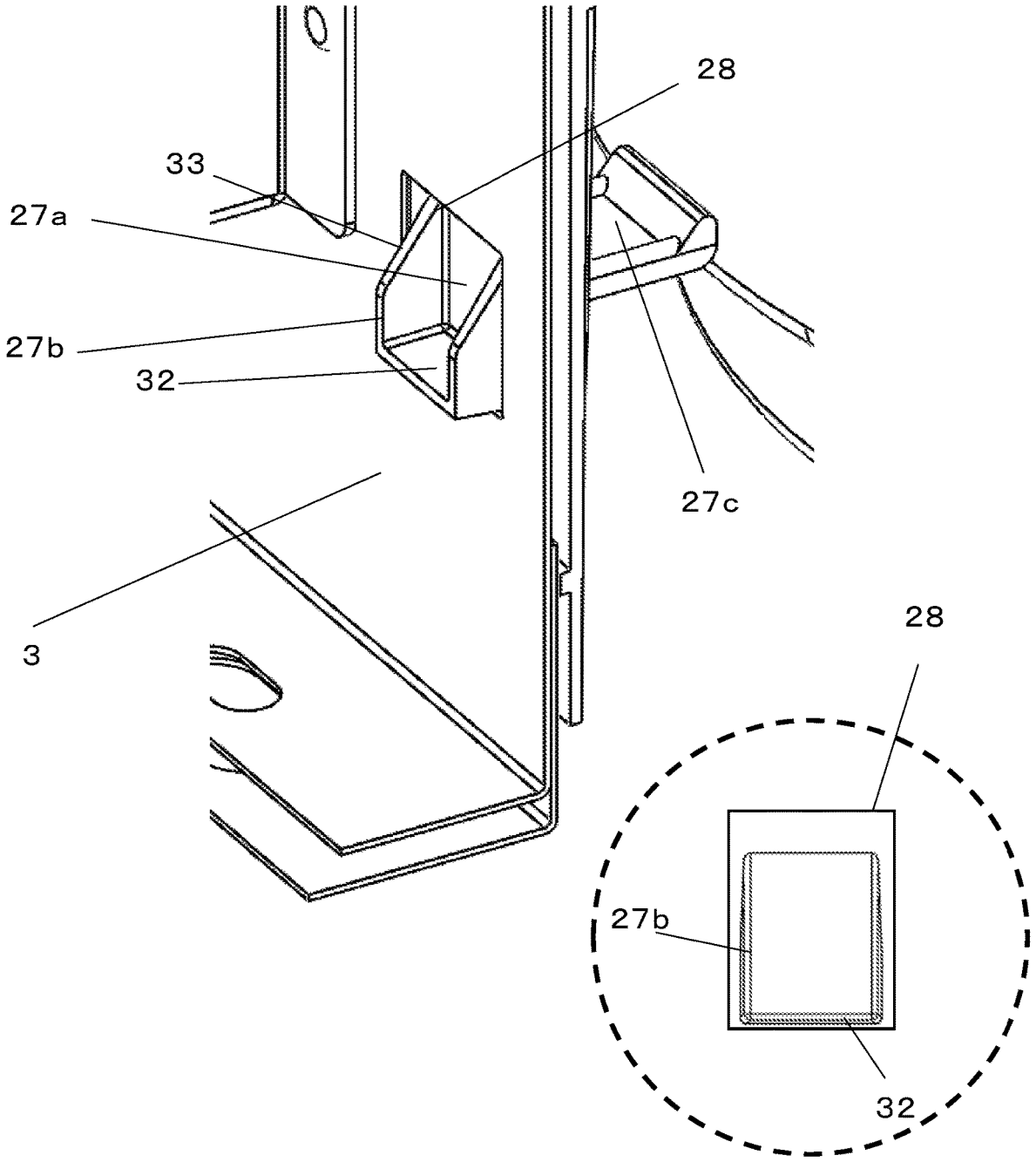
FIG. 11 is a cross-sectional perspective view and a plan view of a positional relation between a temporarily fixed stopper and the adapter.

An exemplary procedure to install a ventilator is explained with reference to FIG. 11, FIG. 12 and FIG. 13. FIG. 11 is a cross-sectional perspective view and a plan view of a positional relation between temporarily fixed stopper 27*b* and adapter 3. FIG. 12 is a cross-sectional perspective view and a plan view of a positional relation between regularly fixed stopper 27*b* and adapter 3. FIG. 13 is a perspective view of an exemplary procedure for installing the ventilator to a ceiling.

As indicated in FIG. 13, to install ventilator 30, adapter 3 is first fixed to a frame by screws and/or any other fixing means, here the frame is previously fixed to an opening on the ceiling. Then, box 1 storing fan case 7 is fixed to adapter 3 by screws and/or any other fixing means.

To fix box 1 to adapter 3, each of guide members 21 provided on each of adjacent side surfaces 1*a* of box 1 slides upward and engages with each of guide receivers 13*a* provided on adapter 3. This controls a clearance between adapter 3 and box 1 with box 1 inserted in the ceiling, and maintains airtightness while achieving engagement between temporary fixation 27 and engaged opening 28.

In inserting temporary fixation 27 into engaged opening 28, a part of slope 33 contacts outlet aperture plate 31 of adapter 3, then base 27*a* resiliently deforms inward air outlet 5 along the inclined side of slope 33. While inserting stopper 27*b* into engaged opening 28, stopper 27*b* gets over engaged opening 28. Base 27*a* recovers its original shape while planar surface 32 contacts the underside of engaged opening 28. Thus, stopper 27*b* protrudes outward adapter 3 through engaged opening 28, resulting in stopper 27*b* got caught on engaged opening 28 of adapter 3. As indicated in FIG. 11, box 1 is temporarily fixed to the ceiling without installer's support with planar surface 32 in contact with the underside of engaged opening 28.

Figure 12:
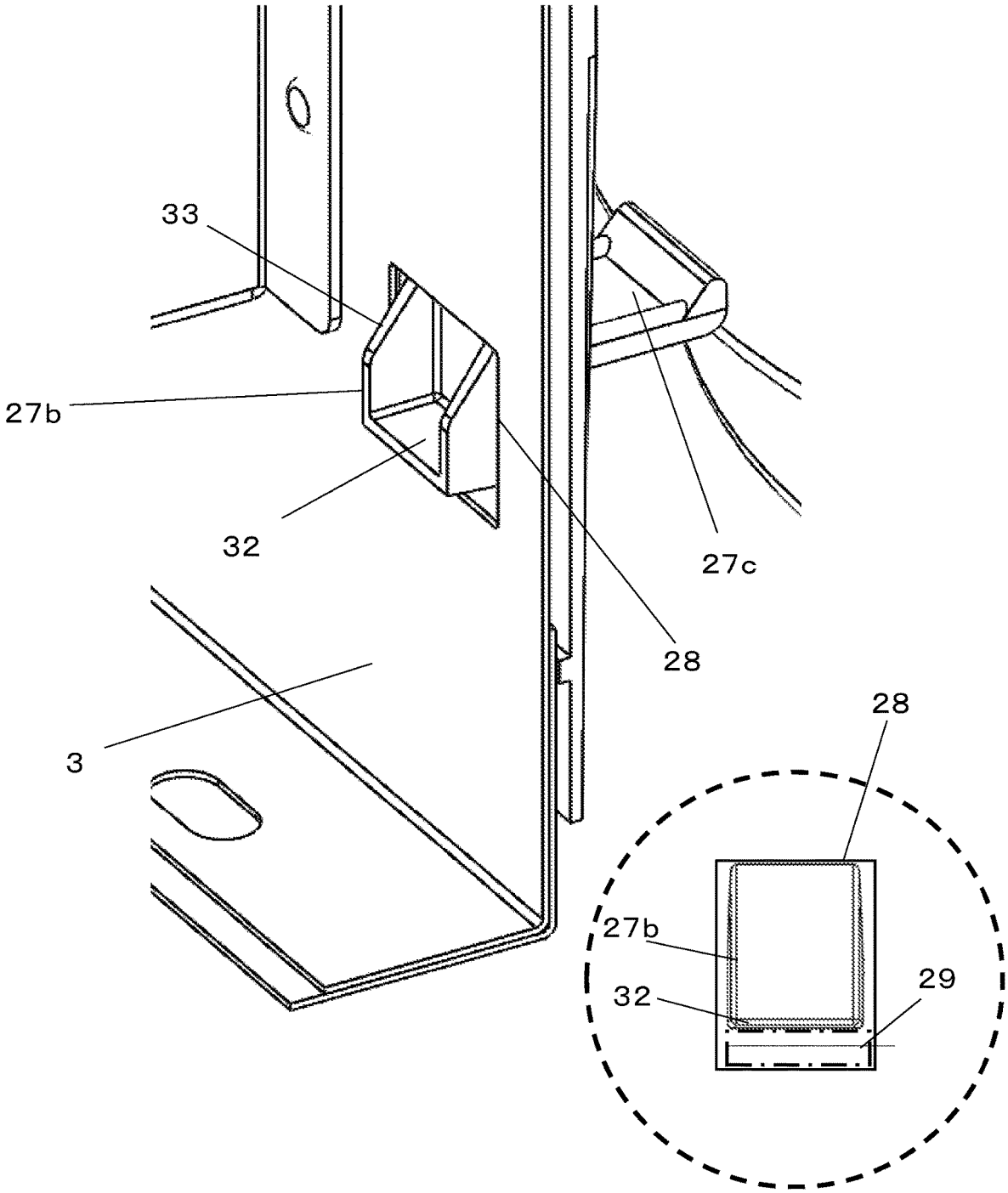
FIG. 12 is a cross-sectional perspective view and a plan view of a positional relation between a regularly fixed stopper and the adapter.
Figure 13:
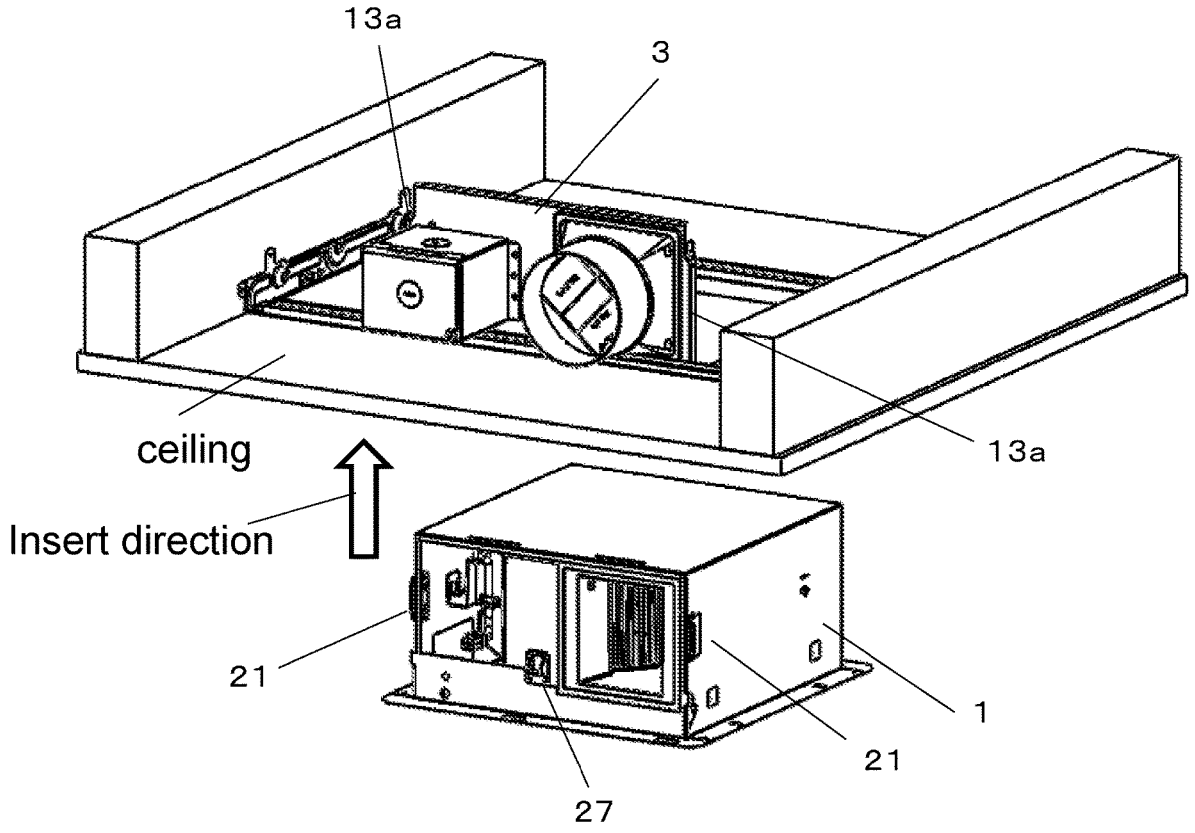
FIG. 13 is a perspective view of an exemplary procedure for installing the ventilator to a ceiling.
Figure 14:
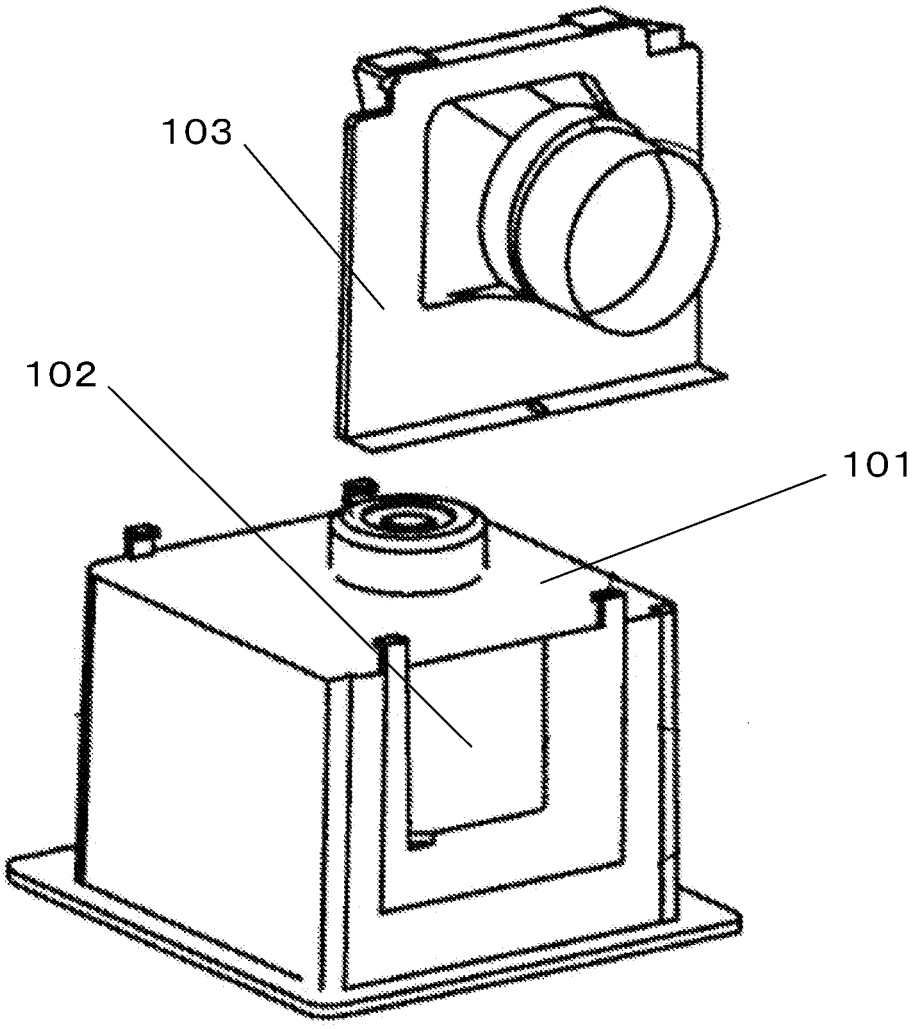
FIG. 14 is a detailed structural view of a conventional ventilator.
Figure 15:
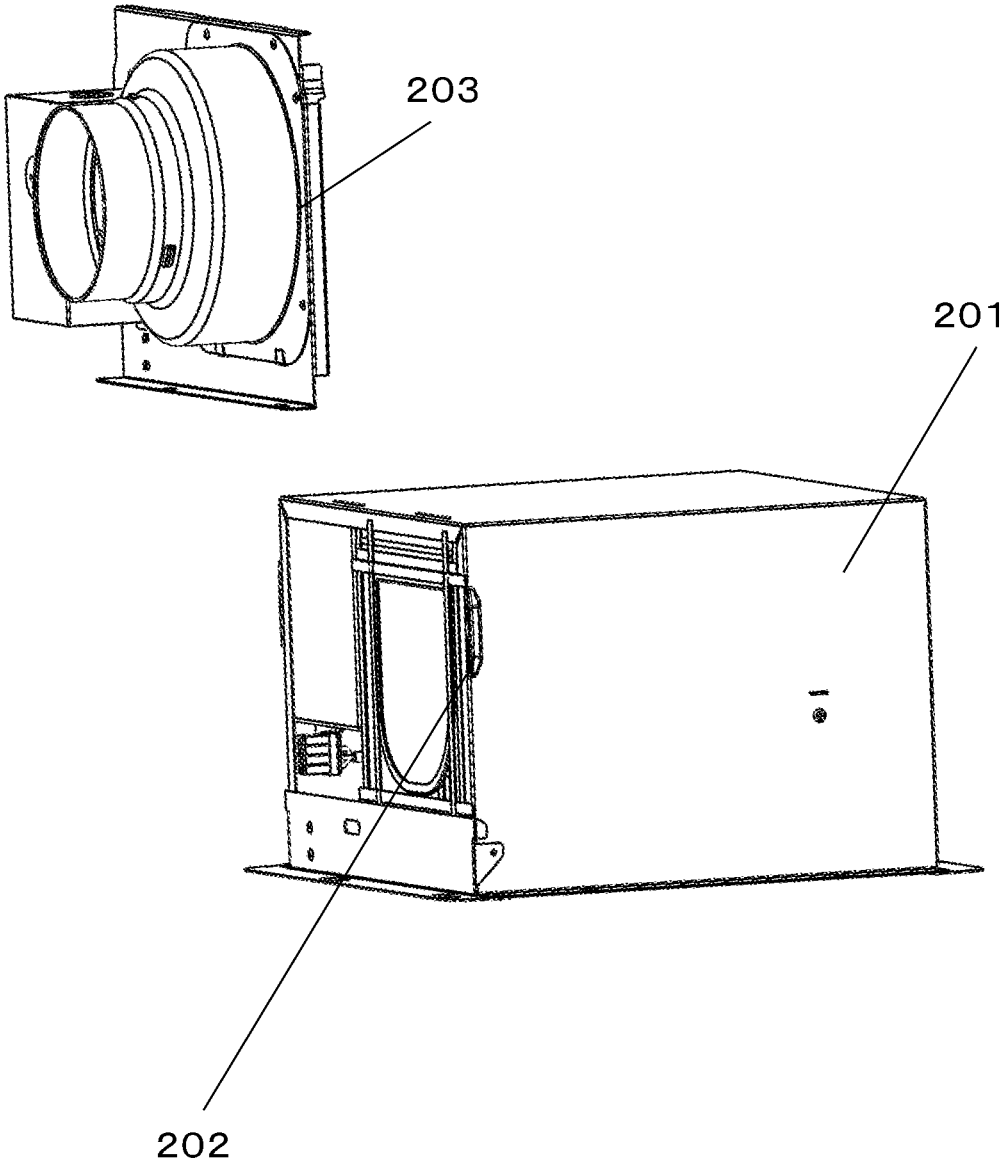
FIG. 15 is a detailed structural view of another conventional ventilator.

As indicated in FIG. 12, sliding space 29 is a clearance formed between planar surface 32 and the underside of engaged opening 28. The height of engaged opening 28 is slightly larger than that of stopper 27*b*. Engaged opening 28 preferably has a height 3 mm to 10 mm larger than that of stopper 27*b*.

Planar surface 32 of temporarily fixed stopper 27*b* contacts the underside of engaged opening 28, and the clearance between planar surface 32 and the underside of engaged opening 28 is substantially zero. Conversely, sliding space 29 is produced between the upside of stopper 27*b* and the upside of engaged opening 28. As engaged opening 28 has the height 3 mm to 10 mm larger than that of stopper 27*b*, thus box 1 is temporarily fixed to adapter 3 at a height 3 mm to 10 mm lower compared to where box 1 is regularly fixed.

As such, temporarily fixed box 1 falls around 5 mm from adapter 3. Thus, the installer easily finds box 1 temporarily fixed to adapter 3, this reduces omission of fixing box 1 to adapter 3 with screws and/or any other fixing means.

As indicated in FIG. 12, temporarily fixed box 1 is regularly fixed to the frame with screws and/or any other fixing means. Screw holes on the frame allow box 1 to be regularly fixed to adapter 3. Additionally, regularly fixed box 1 produces sliding space 29 of 3 mm to 10 mm between the underside of engaged opening 28 and planar surface 32 of stopper 27*b*, resulting in no load applied on stopper 27*b* during operation of ventilator 30.

Providing sliding space 29 to engaged opening 28 allows the installer to clearly understand ventilator 30 is temporarily fixed. Thus, ventilator 30 never remains unfixed or is never subject to dropping from the ceiling.

To clean or maintain ventilator 30, unscrewing regularly fixed box 1 allows it to be temporarily fixed again where planar surface 32 of stopper 27*b* and the underside of engaged opening 28 contacts.

For example, supporting box 1 with the right hand, pinching engagement release 27*c* and pulling it downward with the left hand allows the installer to release engagement between engaged opening 28 and temporary fixation 27, which is resiliently deformable. Thus, the installer can detach box 1 easily and safely.

INDUSTRIAL APPLICABILITY

A ventilator according to the present disclosure, where the ventilator includes an adapter and a box as independent components, is useful as the ventilator enabling to improve workability and airtightness.

REFERENCE MARKS IN THE DRAWINGS

1 box
1*a* adjacent side surface
1*b* top surface
3 adapter
3*a* guide
4 air inlet
5, 5*b* air outlet
6 exhaust air path
7 fan case
8 motor
9 fan
10 electrical board case
11 motor support
12*a*, 12*b* through hole
12*c* square through hole
13 adapter plate
13*a* guide receiver
14 duct connection
15 orifice
16 power source connection
16*a* power connection base
16*b* power connection cover
17 concavity
21 guide member
27 temporary fixation
28 engaged opening
29 sliding space
30 ventilator
31 outlet aperture plate
32 planar surface
101 box
103 adapter
201 box
203 adapter

The invention claimed is:

1. A ventilator comprising:

a box having an air inlet on a bottom surface of the box and an air outlet on a side surface of the box, the side surface being different from the bottom surface;

a fan case for storing a fan and sending air from the air inlet to the air outlet; and an adapter independent of the box and to be fixed to the side surface including the air outlet;

wherein the fan case includes a temporary fixation for temporarily fixing the box to the adapter, wherein the temporary fixation temporarily and slidably fixes the box to the adapter with the box engaged with the adapter, wherein the temporary fixation includes:

a base provided on the fan case, the base being in parallel with the side surface of the box and resiliently moving toward and away from the side surface; and a stopper provided on the base, the stopper protruding through the adapter and inserted into an engaged opening provided on the adapter by a slide between the fan case and the adapter, wherein the engaged opening includes a sliding space allowing the stopper to vertically move inside the engaged opening with the stopper inserted into the engaged opening, wherein the temporary fixation includes an engagement release, which protrudes opposite to the stopper on the base, allowing the base to deform to release an engagement between the stopper and the engaged opening, and wherein the engagement release is disposed on the fan case closer to a top surface of the box than to an air inlet opening adjacent to the bottom surface.

2. The ventilator according to claim 1 further comprising:

a regular fixation for fixing the box to be unable to slide with respect to the adapter in addition to the temporary fixation for slidably fixing the box to the adapter.

3. The ventilator according to claim 1, wherein a gravity center of the box is disposed close to the air outlet of the box.

4. The ventilator according to claim 3, wherein a rotating shaft of the fan is disposed close to the air outlet of the box.

5. The ventilator according to claim 1, wherein the box includes a guide member, which is on an adjacent side surface adjoining the side surface of the box, to slide with respect to the adapter toward the top surface of the box opposite to the bottom surface.

6. The ventilator according to claim 1, wherein the temporary fixation includes a reinforce for controlling deformation of the engagement release.

* * * * *